US006259240B1

(12) United States Patent
Smith

(10) Patent No.: US 6,259,240 B1
(45) Date of Patent: Jul. 10, 2001

(54) POWER-UP CIRCUIT FOR ANALOG CIRCUIT

(75) Inventor: Malcolm H. Smith, Macungie, PA (US)

(73) Assignee: Agere Systems Guardian Corp., Miami Lakes, FL (US)

( * ) Notice: Subject to any disclaimer, the term of this patent is extended or adjusted under 35 U.S.C. 154(b) by 0 days.

(21) Appl. No.: 09/574,860

(22) Filed: May 19, 2000

(51) Int. Cl.[7] ..... G05F 3/16
(52) U.S. Cl. ..... 323/313; 323/315; 323/901
(58) Field of Search ..... 323/313, 314, 323/315, 901; 363/49

(56) References Cited

U.S. PATENT DOCUMENTS 4,839,535 * 6/1989 Miller ..... 307/296.7
5,452,195 * 9/1995 Lehr et al. ..... 363/21
5,666,046 * 9/1997 Mietus ..... 323/313
5,668,467 * 9/1997 Pease ..... 323/315
5,751,142 * 5/1998 Dosho et al. ..... 323/316
6,133,719 * 10/2000 Maulik ..... 323/313

* cited by examiner

*Primary Examiner*—Adolf Deneke Berhane
(74) *Attorney, Agent, or Firm*—Schnader Harrison Segal & Lewis LLP

(57) ABSTRACT

A start-up circuit for providing current to an analog circuit wherein the analog circuit contains an operational amplifier. The start-up circuit makes use of normal operation of the analog circuit to perform a power-up function. A node being powered up is at substantially all times controlled by the operational amplifier, minimizing performance variation resulting from process and temperature variations.

19 Claims, 4 Drawing Sheets

POWER-UP CIRCUIT FOR ANALOG CIRCUIT

FIELD OF THE INVENTION

The invention relates to a start-up circuit for enabling a circuit from a power-down mode.

BACKGROUND OF THE INVENTION

To reduce power consumption, circuit portions may be powered down when not in use, and powered up when they are again needed. Start-up circuitry is used to power-up desired circuit portions when needed. This mechanism increases battery life which is particularly desirable for portable electronic devices.

Previous start-up circuits include circuits having an NMOS transistor source tied to a node to be powered up and a drain tied to a power supply, such that the transistor is turned on if the source drops below a threshold which is established below the transistor gate voltage. The transistor is turned off if the source voltage becomes greater than the gate voltage plus the threshold voltage.

Other start-up circuits include those which provide current to a the node to be powered up and then detect when the circuit has powered up and thereafter cease supply of current to the node.

Circuits, for example mixed-signal circuits comprising analog-to-digital and digital-to-analog conversion functions, often require a reference voltage for operation. Voltage reference circuitry establishes the reference voltage when activated by an enabling signal. When high speed operation of a device is desirable it is advantageous to establish the reference voltage within a short duration of receiving the enabling signal. Start-up circuits have been used in conjunction with voltage reference circuits to improve response time.

FIG. 1 depicts a known start-up circuit 100 used in conjunction with a voltage reference circuit 102. Start-up circuit 100 is shown by dotted lines. Voltage reference circuit 102 has two possible equilibrium points, one of which corresponds to zero voltage and zero current, and a second, non-zero equilibrium point, which corresponds to a useful reference voltage. Therefore, voltage reference circuit 102 must be designed to choose only the non-zero equilibrium point to establish the reference voltage. Start-up circuit 100 is provided to allow voltage reference circuit 102 to utilize only the desired equilibrium point. If voltage reference circuit 102 is at the undesired equilibrium point, the voltage is zero and therefore, $I_1$ and $I_2$ are zero. Consequently, transistor 104 provides current in transistor 106 which then moves voltage reference circuit 102 to the non-zero equilibrium point. Transistor 104's source voltage increases as the desired equilibrium point is approached. This causes the current through transistor 104 to decrease. When voltage reference circuit 102 reaches the non-zero equilibrium point, the current through transistor 106 will be substantially the same as the current through transistor 108. Transistor 110 and resistor 112 set the gate bias voltage for transistor 104. Voltage reference circuit 102 is on within a gate bias voltage window. Therefore, the gate bias voltage must be high enough to turn voltage reference circuit 102 on but must not exceed the upper limit of the voltage window.

At startup, no current flows in bandgap circuit 204. Node 214 is pulled down by the kick-start circuit and node 212 is pulled up by the kick-start circuit. This causes current to flow in transistor 208 and by reflection in transistor 206 which holds node 212 above ground and this reflects current into the other branch to hold node 214 below the power supply and keep bandgap circuit 204 on. When current flows in the transistors of bankgap rteference circuit 204, kick-start circuit 202 is turned off. This occurs because transistor 205 mirrors the current in transistor 206 which drives the gate node of transistor 209 high and so pulls down node 211. Driving node 211 low turns off the current mirrors in kick-start circuit 202, so it stops sourcing and sinking current to the bandgap reference circuit 204. Resistor 210 ensures that current flows in kick-start circuit 202 when band gap reference circuit 204 is powered down.

SUMMARY OF THE INVENTION

A start-up circuit is disclosed for providing current to an analog circuit wherein the analog circuit contains an operational amplifier. The start-up circuit makes use of normal operation of the analog circuit to perform a power-up function. A node being powered up is at substantially all times controlled by the operational amplifier, minimizing performance variation resulting from process and temperature variations.

DETAILED DESCRIPTION OF THE INVENTION

A start-up circuit in accordance with aspects of the invention provides current to power-up an analog circuit. The start-up circuit makes use of normal operation of the analog circuit to perform a power-up function. A node being powered-up is at substantially all times under the control of an op-amp present in the circuit. Therefore, the stewing and settling behavior of the circuit during a power-up mode is dependent on the op-amp. This dependency provides less variation with process and temperature changes than a direct connection to a start-up circuit. The op-amp will have a relatively high slew rate while the circuit is powering up and a relatively high gain and low power consumption once the circuit is powered up, which is the desired condition for both regimes.

One embodiment of the start-up circuit comprises a means for receiving a voltage and an inverted power-down signal. Further included is a means for performing a logic function and a means for activating the logic means. The activating means receives a signal from the voltage receiving means. The logic means is capable of receiving a power down signal and a signal from the activating means. Additionally, a means is provided for receiving a signal from the logic means. A current mirroring means mirrors the current output by the logic signal receiving means. The mirrored current is output to a means for controlling a node in the analog circuit to be powered up wherein the controlling means is a portion of the analog circuit. In another embodiment the circuit further comprises a means to minimize power consumed by the start-up circuit wherein the minimizing means is connected to the activating means, the logic receiving means and an input of the logic means.

Preferably the controlling means is an op-amp and the logic means is a NOR gate. The minimizing means is a resistor, and more preferably a MOSFET. The greater the resistance of the minimizing means, the smaller the amount of power used by the start-up circuit. Thus it is desirable to use as large a resistance as possible.

Figure 1:
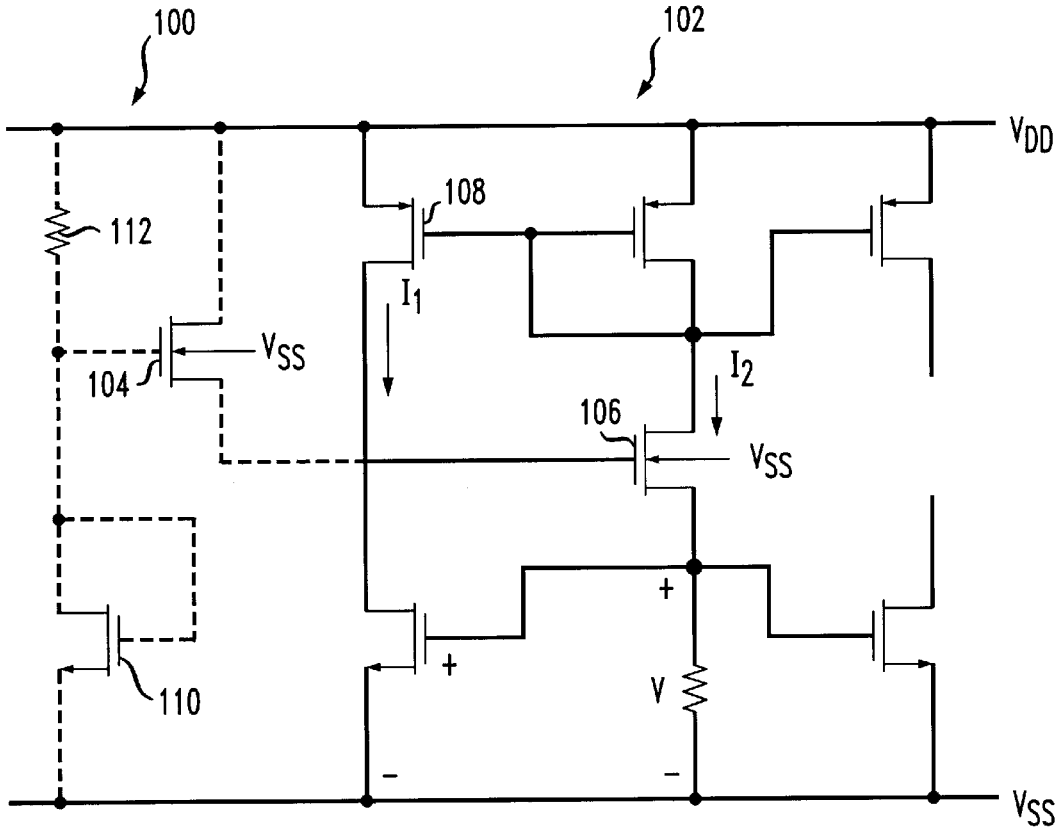
FIG. 1 depicts a prior art start-up circuit.
Figure 2:
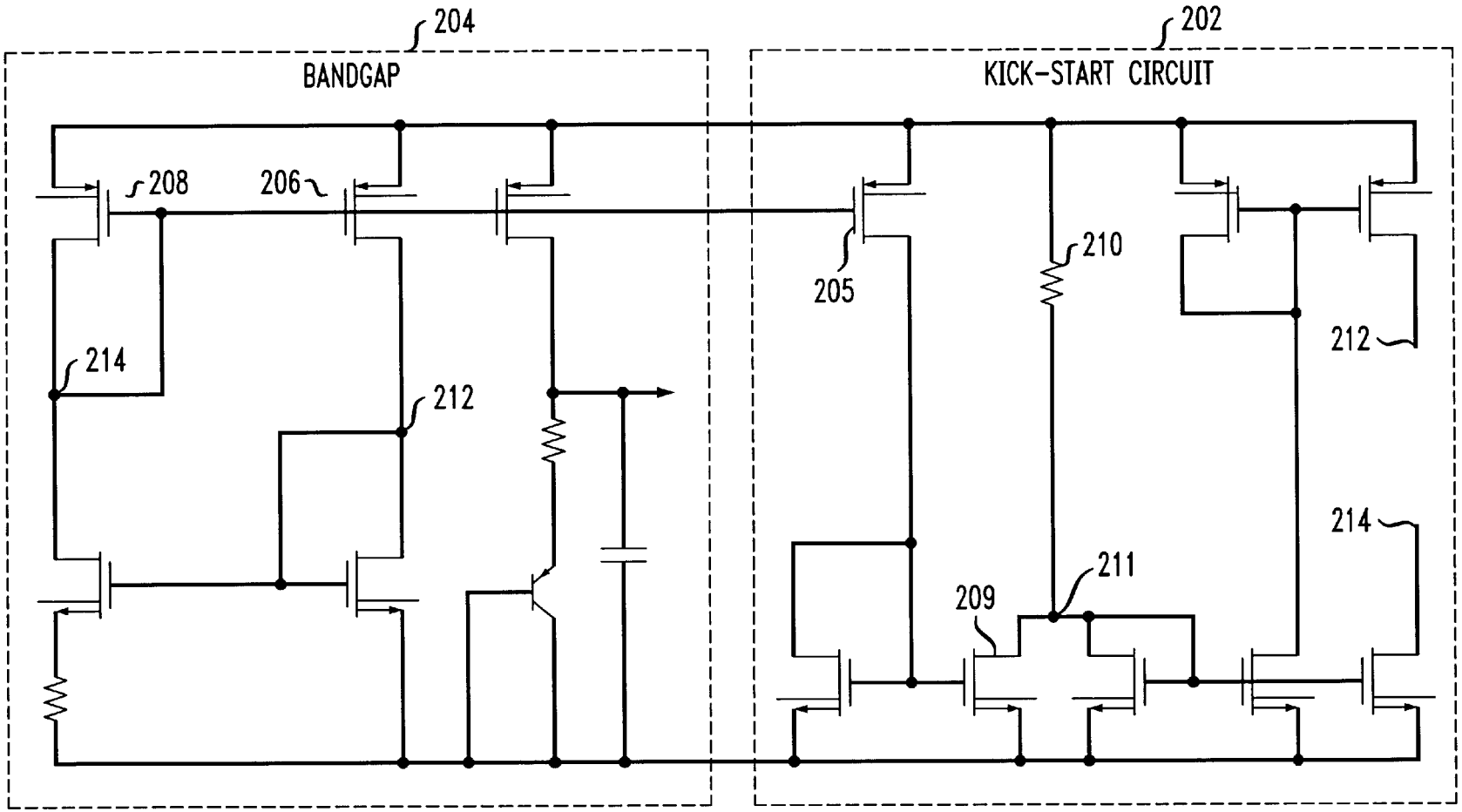
FIG. 2 depicts another prior art start-up circuit.
Figure 3:
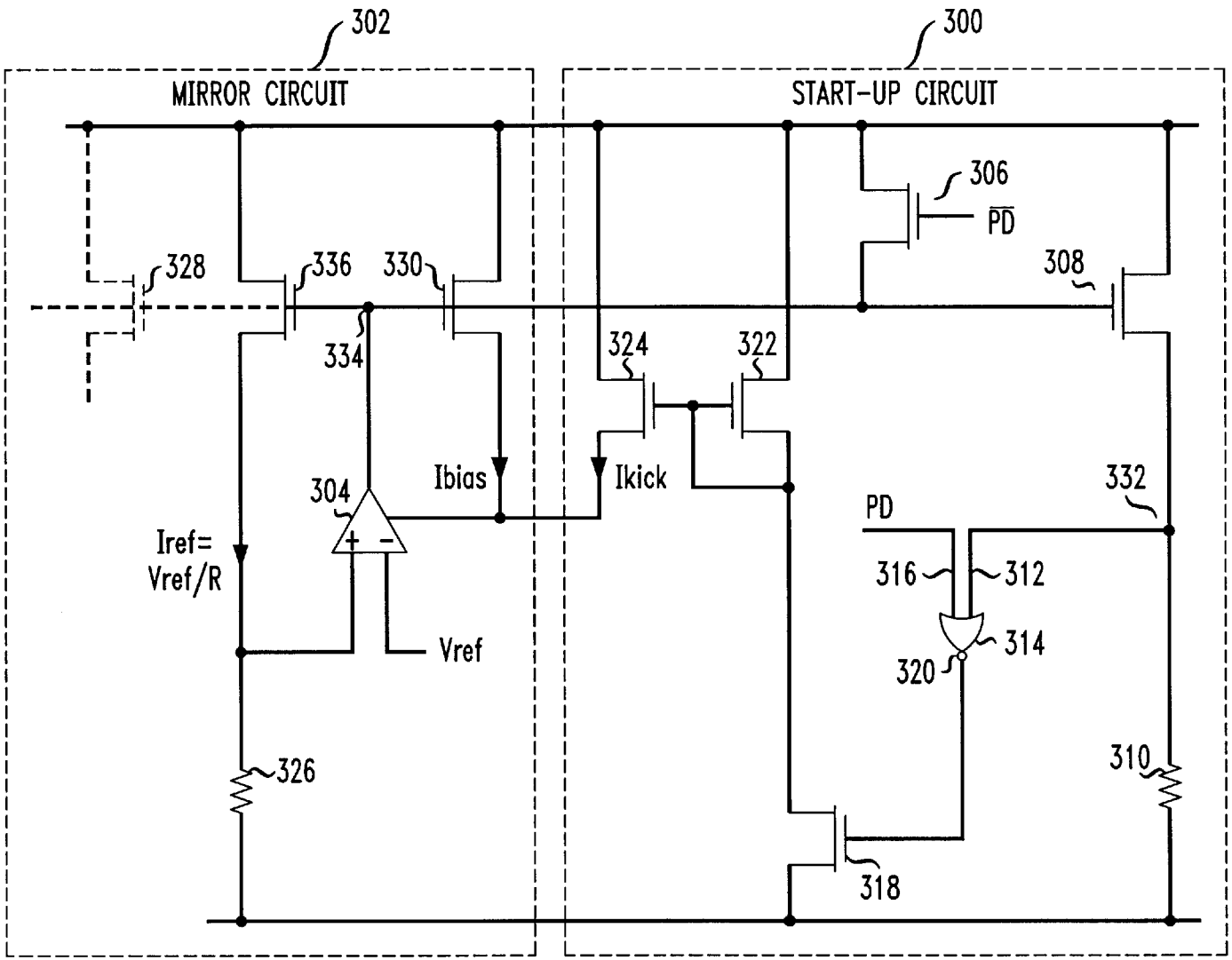
FIG. 3 depicts one embodiment of the invention.

FIG. 3 depicts an embodiment of start-up circuit 300 used in conjunction with mirror circuit 302 wherein mirror circuit 302 is driven by op-amp 304. Start-up circuit 300 comprises a plurality of transistors. The embodiment depicted in FIG. 3 comprises five transistors 306, 308, 318, 322 and 324, a resistor 310 and a NOR gate 314. First transistor 306 has a first electrode for receiving a voltage and a controlling electrode for receiving an inverted power-down signal. Second transistor 308 is coupled to first transistor 306 and resistor 310 which has a first electrode to receive a voltage. In one embodiment resistor 310 is a transistor. Second transistor 308 is coupled to first input terminal 312 of NOR gate 314. Second input terminal 316 of NOR gate 314 is capable of receiving a power-down signal. Third transistor 318 is coupled to NOR gate 314 at NOR gate 314's output terminal 320. Transistor 318 is further coupled to resistor 310. Resistor 310 and third transistor 318 are coupled to a ground potential. Fourth transistor 322 is coupled to third transistor 318 and has a first electrode to receive a voltage. Fifth transistor 324 is coupled to fourth transistor 322, and has a first electrode to receive a voltage and a second electrode to provide a current to analog circuit 302.

Start-up circuit 300 supplements op-amp 304 of the mirror circuit with a start-up current during power up to allow faster slewing. Once the mirror circuit is powered up, the start-up circuit current is turned off, so that op-amp 304 has relatively low current drain and high gain during normal operation.

During normal operation, mirror circuit op-amp 304 compares a reference voltage, $V_{ref}$, to a voltage across resistor 326 having resistance R, and equalizes the two voltages, thereby generating a known current of $I_{ref}=V_{ref}/R$. This current is mirrored in transistor 328 and transistor 330 to bias op-amp 304. Because op-amp 304 uses the mirrored version of the current for its bias current, it needs a start-up circuit. This function may be provided by start-up circuit 300 to the right of main circuit 302 in FIG. 3. During power down, the power down signal is high so the output of NOR gate 314 is low. When the output of NOR gate 314 is high, transistor 318 starts to sink a large current. This current is mirrored from transistor 322 to transistor 324 and so biases op-amp 304. $I_{kick}$ is relatively large, so op-amp 304 is biased at high current allowing the output of op-amp 304 to slew quickly. This causes node 334 to be pulled down quickly. When transistor 336 turns on, so will transistor 308 which will pull node 332 up to the power supply and turn NOR gate 314 off, thereby stopping the start-up current. The turn off time for $I_{kick}$ is dictated by the time it takes to discharge the capacitance attached to the controlling electrode of transistor 322 through a second electrode of transistor 322. By adjusting the sizes of transistors 322 and 324 it is possible to adjust the capacitance on the controlling electrode and the transconductance of transistor 322 so that the time for $I_{kick}$ to turn off can be controlled.

When the power down signal is asserted, transistor 306 pulls node 334 high and the flow of all currents in the circuit is substantially stopped. Start-up circuit 300 consumes power during normal operation of the mirror because transistor 308 is on. However, this current is generally small and can be kept to a minimum by making resistor 310 as large as possible, for example by using a long, narrow MOSFET.

Figure 4:
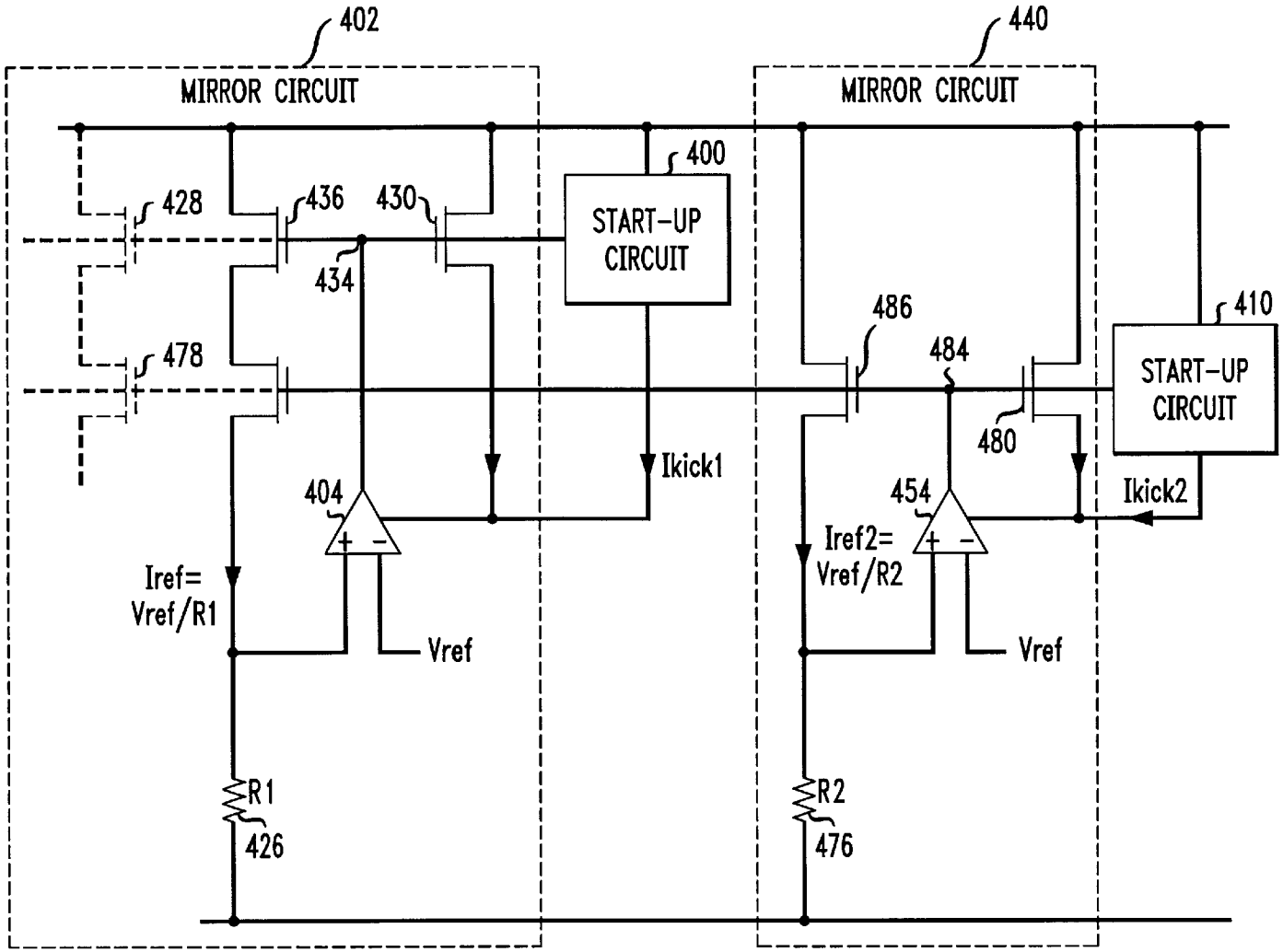
FIG. 4 depicts another embodiment of the invention.

FIG. 4 depicts an embodiment of the invention wherein a start-up circuit is used to power-up a low voltage cascode circuit. To increase control, a second op-amp and a second start-up circuit with a second resistor may be used. The cascode bias voltage may be controlled by ratioing the start-up circuit's transistors and the resistors. Additional op-amps and start-up circuits may be used if further control is desired.

In the particular embodiment depicted in FIG. 4 start-up circuits 400 and 410 are used in conjunction with mirror circuits 402 and 440 wherein mirror circuit 402 is driven by op-amp 404 and mirror circuit 440 is driven by op-amp 454. Mirror circuits 402 and 440 are analogous to mirror circuit 302 depicted in FIG. 3. Start-up circuits 400 and 410 comprise circuits analogous to start-up circuit 300 depicted in FIG. 3.

During normal operation, op-amp 404 of mirror circuit 402, and op-amp 454 of mirror circuit 440 compare reference voltages $V_{ref1}$ and $V_{ref2}$ to a voltage across resistors 426 and 476, respectively, wherein resistor 426 has a resistance $R_1$ and resistor 476 has a resistance $R_2$. Op-amps 404 and 454 equalize the voltages they are comparing, thereby operating known currents of $I_{ref}=V_{ref1}/R_1$ and $I_{ref2}=V_{rf2}/R_2$ in start-up circuits 400 and 410, respectively. Current $I_{ref}$, is mirrored in transistors 428 and 430, and $I_{ref2}$ is mirrored in transistors 478 and 480. The currents mirrored in transistors 430 and 480 bias op-amps 404 and 454, respectively. Because op-amps 404 and 454 use the mirrored version of the current for their bias current, they need a start-up circuit. This function may be provided by start-up circuits 400 and 410. During start up, the power down signal causes start-up circuits 400 and 410 to bias op-amps 404 and 454, respectively, by supplying $I_{kick}$ and $I_{kick2}$, respectively. The method for doing so is described above with respect to start-up circuit 300. Because $I_{kick1}$ and $I_{kick2}$ are relatively large, op-amps 404 and 454 are biased at high current allowing the outputs of op-amps 404 and 454 to slew quickly. This causes nodes 434 and 484 to be pulled down quickly. When transistors 436 and 486 turn on, the start-up currents $I_{kick1}$ and $I_{kick2}$ will be turned off.

In one embodiment of the invention the transistors are bipolar transistors and in another embodiment they are MOSFETs.

In yet another embodiment the analog circuit is a current steering circuit for digital to analog converter, and in a further embodiment the analog circuit is a band gap reference circuit.

Embodiments of the start-up circuit may be incorporated into a semiconductor device.

While the invention has been described in what is presently considered to be preferred embodiments, many variations and modifications will become apparent to those skilled in the art. Accordingly, it is intended that the invention not be limited to the specific illustrative embodiments but be interpreted within the full spirit and scope of the appended claims.

What is claimed is:

1. A start-up circuit for providing current to an analog circuit containing an operational amplifier, wherein the start-up circuit makes use of normal operation of the analog circuit to perform a power-up function and a node being powered up is at substantially all times controlled by the operational amplifier and wherein the start-up circuit comprises:

a first transistor having a first electrode for receiving a voltage and a controlling electrode for receiving an inverted power-down signal;

a second transistor coupled to the first transistor, a resistor and having a first electrode to receive a voltage;

a NOR gate having a first and second input terminal and an output terminal, the second transistor coupled to the first input terminal and the second input terminal capable of receiving a power-down signal;

a third transistor coupled to the NOR gate output terminal and the resistor, wherein the resistor and the third transistor are coupled to a ground potential;

a fourth transistor coupled to the third transistor and having a first electrode to receive a voltage; and a fifth transistor coupled to the fourth transistor, and having a first electrode to receive a voltage and a second electrode to provide a current to the analog circuit.

2. The start-up circuit of claim 1 wherein the resistor is a transistor and is turned off during operation of the analog circuit.

3. The start-up circuit of claim 1 wherein the transistors are bipolar transistors.

4. The start-up circuit of claim 1 wherein the transistors are MOSFETs.

5. A start-up circuit for providing current to an analog circuit comprising:

means for receiving a voltage and an inverted power-down signal;

means for performing a logic function;

means for activating the logic means wherein the activating means receives a signal from the voltage receiving means, and wherein the logic means is capable of receiving a power down signal and a signal from the activating means;

means for receiving a signal from the logic means;

means for mirroring a current wherein the current mirrored is supplied by the logic signal receiving means; and means for controlling a node in the analog circuit to be powered up wherein the controlling means receives a signal from the current mirroring means and the controlling means is a portion of the analog circuit.

6. The start-up circuit of claim 5 wherein the controlling means is an op-amp.

7. The start-up circuit of claim 5 wherein the logic means is a NOR gate.

8. The start-up circuit of claim 5 wherein the analog circuit is a mirror circuit.

9. The start-up circuit of claim 5 wherein the analog circuit is a cascode circuit.

10. The start-up circuit of claim 5 wherein the analog circuit is a band gap reference circuit.

11. The start-up circuit of claim 5 wherein the analog circuit is a current steering circuit for a digital to analog converter.

12. An integrated circuit comprising the start-up circuit of claim 5.

13. The start-up circuit of claim 5 further comprising a means to minimize power consumed by the start-up circuit wherein the minimizing means connected to the activating means, the logic receiving means and an input of the logic means.

14. A start-up circuit for providing current to an analog circuit containing an operational amplifier, wherein the start-up circuit makes use of normal operation of the analog circuit to perform a power-up function, a node being powered up is at substantially all times controlled by the operational amplifier, and logic means to control when the start-up current flows to the operational amplifier.

15. The start-up circuit of claim 14 wherein the analog circuit is a mirror circuit.

16. The start-up circuit of claim 14 wherein the analog circuit is a cascode circuit.

17. The start-up circuit of claim 14 wherein the analog circuit is a band gap reference circuit.

18. The start-up circuit of claim 14 wherein the analog circuit is a current steering circuit for a digital to analog converter.

19. An integrated circuit comprising the start-up circuit of claim 14.

* * * * *